United States Patent [19]

Arnold

[11] Patent Number: 5,042,166

[45] Date of Patent: Aug. 27, 1991

[54] FABRIC COVER MARKING DEVICE AND METHOD

[76] Inventor: Dorothy Arnold, 625 Sunnyside Rd., Vermilion, Ohio 44089

[21] Appl. No.: 497,114

[22] Filed: Mar. 21, 1990

[51] Int. Cl.[5] ..... G01D 21/00

[52] U.S. Cl. ..... 33/644; 33/669; 33/578; 114/361

[58] Field of Search ..... 33/644, 622, 666, 669, 33/679, 677, 574, 575, 576, 578, DIG. 10; 114/361

[56] References Cited

U.S. PATENT DOCUMENTS

| | | | |
|---|---|---|---|
| 1,645,499 | 10/1927 | Fenton . | |
| 1,647,962 | 11/1927 | Fenton . | |
| 1,778,677 | 10/1930 | King . | |
| 1,787,143 | 12/1930 | Clark et al. . | |
| 2,257,787 | 10/1941 | Cohen . | |
| 2,638,682 | 5/1953 | Russell | 33/574 |
| 2,659,983 | 11/1953 | Zore | 33/578 |
| 2,666,546 | 1/1954 | Reilly | 33/DIG. 10 |
| 2,721,393 | 10/1955 | Frisbee | 33/574 |
| 2,961,725 | 5/1963 | McGee . | |
| 3,088,295 | 11/1960 | Haines . | |
| 3,202,193 | 8/1965 | Ware . | |
| 3,203,105 | 8/1965 | Whistler et al. | 33/578 |
| 3,924,331 | 12/1975 | Goosen | 33/DIG. 10 |
| 3,940,857 | 3/1976 | Giordano | 33/DIG. 10 |
| 4,059,905 | 11/1977 | Wieting | 33/DIG. 10 |
| 4,359,302 | 11/1982 | Payne | 33/DIG. 10 |
| 4,507,344 | 3/1985 | Baughman . | |

*Primary Examiner*—Thomas B. Will

*Attorney, Agent, or Firm*—Fay, Sharpe, Beall, Fagan, Minnich & McKee

[57] ABSTRACT

A fabric cover marking device is for marking the location on a fabric cover for a snap socket engageable with a snap stud mounted on a structure to be covered. The device comprises a socket portion and a pin portion. The socket portion has a front side releasably engageable with the snap stud and a rear side. The pin portion is mounted on the rear side of the socket portion and is capable of piercing the fabric cover when the socket portion is engaged with the snap stud. The method for manufacturing a fabric cover for covering a structure having mounted thereon a plurality of snap studs to which the cover is to be fastened comprises the steps of securing onto each of the snap studs a marking device comprising a snap socket portion having a pin portion mounted thereon, disposing a fabric cover over the structure, piercing the fabric cover with the pin portions of the marking device secured to the snap studs, marking the fabric cover at each of the locations where the fabric cover was pierced by one of the pin portions, and securing a snap socket to the fabric cover at each marked position.

8 Claims, 2 Drawing Sheets

FABRIC COVER MARKING DEVICE AND METHOD

BACKGROUND OF THE INVENTION

The present invention relates to a fabric cover marking device and method. In particular, the present invention relates to a device used for marking the locations of snap fasteners on a boat cover or the like and to a method for manufacturing a fabric cover for attachment to snap studs mounted on a structure to be covered.

Fabric boat covers, such as those typically used to cover the cockpit area of a sail boat or cabin cruiser, normally are fastened in place by snap fasteners. Snap sockets are mounted to the cover, typically by riveting, in selected locations to be engageable with corresponding snap studs that are threaded into the boat structure around the periphery of the cockpit opening.

The conventional method of making such covers uses spring-loaded clamps to secure canvas or plastic material to the snap studs. The areas around the clamps then are marked. Finally, the cover material is taken back to the upholsterer's shop, where snap sockets are riveted into the material at the marked locations.

The step of marking the fabric with the socket locations is particularly time consuming, due mostly to the nature of the clamps used. The clamps typically used are quite heavy and unwieldy and often have to be resecured several times before the entire cover is clamped down. Moreover, the clamps frequently disengage from the snap studs and fall off into the water, entailing further delay and occasional loss of the clamps, which are expensive to replace.

The present invention is intended to provide a fabric cover marking device that will reliably secure the fabric to the snap studs and facilitate the marking of the locations of the snap sockets.

The present invention also is intended to provide a fabric cover marking device that is relatively inexpensive and that reduces the time needed to mark the locations of the snap sockets.

In addition, the present invention is intended to provide an improved method of manufacturing a fabric cover to be attached to snap studs mounted on the structure to be covered.

Additional advantages of the present invention will be set forth in part in the description that follows, and in part will be obvious from that description or can be learned by practice of the invention. The advantages of the invention can be realized and obtained by the apparatus and method particularly pointed out in the appended claims.

SUMMARY OF THE INVENTION

The present invention overcomes the problems of prior art fabric cover marking devices and methods by providing a marking device that can be secured directly to the snap sockets mounted on the structure to be covered. The marking device includes a pin portion that can pierce the fabric and hold it in place while the desired position of the snap socket is marked.

To overcome the problems of the prior art fabric cover marking devices, and in accordance with the purpose of the invention, as embodied and broadly described herein, the fabric cover marking device of this invention is for marking the location of a snap socket on a fabric cover, the snap socket being engageable with a snap stud mounted on a structure to be covered. The device comprises a socket portion and a pin portion. The socket portion is releasably engageable with the snap stud. The pin portion is mounted on the socket portion and is capable of marking the fabric cover by piercing the fabric cover when the socket portion is engaged with the snap stud.

Broadly, the method of the invention is for manufacturing a fabric cover for covering a structure having mounted thereon a plurality of snap studs to which the cover is to be fastened, which method comprises the steps of securing onto each of the snap studs a marking device comprising a snap socket portion having a pin portion mounted thereon, disposing a fabric cover over the structure, piercing the fabric cover with the pin portions of the marking devices secured to the snap studs, and securing a snap socket to the fabric cover at each position where the fabric cover was pierced by one of the pin portions.

The accompanying drawings, which are incorporated in and which constitute a part of this specification, illustrate at least one embodiment of the invention and, together with the description, explain the principles of the invention.

DESCRIPTION OF THE PREFERRED EMBODIMENT

Reference now will be made in detail to the presently preferred embodiment of the invention, an example of which is illustrated in the accompanying drawings.

The present invention will be described with reference to a fabric cover for a motor boat. FIG. ; illustrates motor boat A, which is to be covered with fabric cover B. A plurality of snap studs 10 are mounted on top deck of boat A. When finished, fabric cover B will include a plurality of snap sockets engageable with snap studs 10 so that fabric cover B is removably secured to and covers boat A. As will be understood by those of ordinary skill in the art, snap studs 10 can alternatively be mounted on the upper edge of windshield assembly C of boat A, so that fabric cover B covers only the cockpit area.

Figure 3:
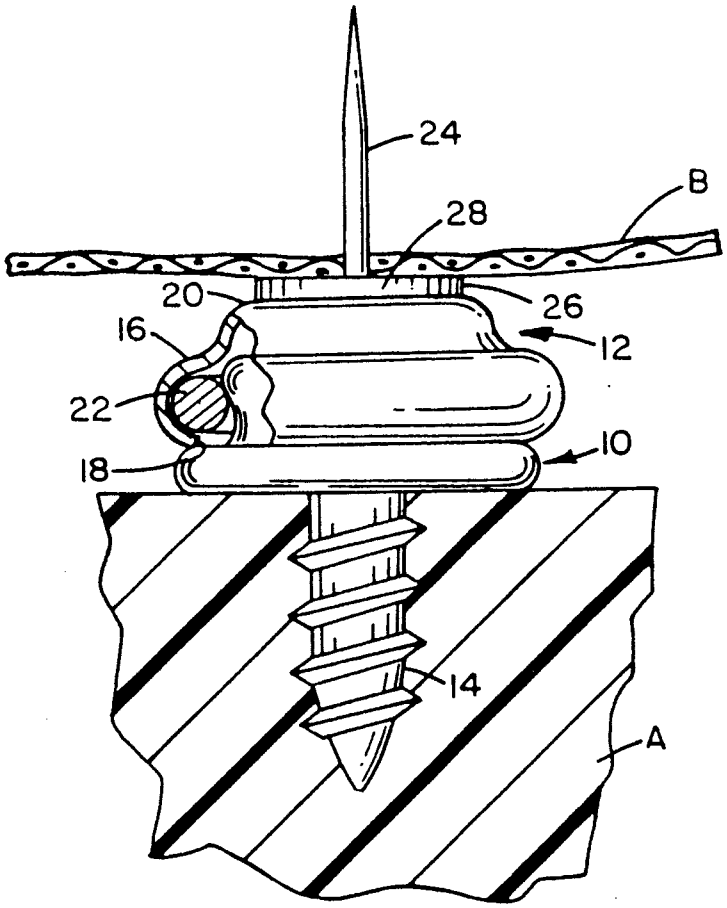
FIG. 3 is a partially cut away cross-sectional view of the fabric cover marking device of the present invention shown fastened to a snap stud and engaging a fabric cover.
Figure 2:
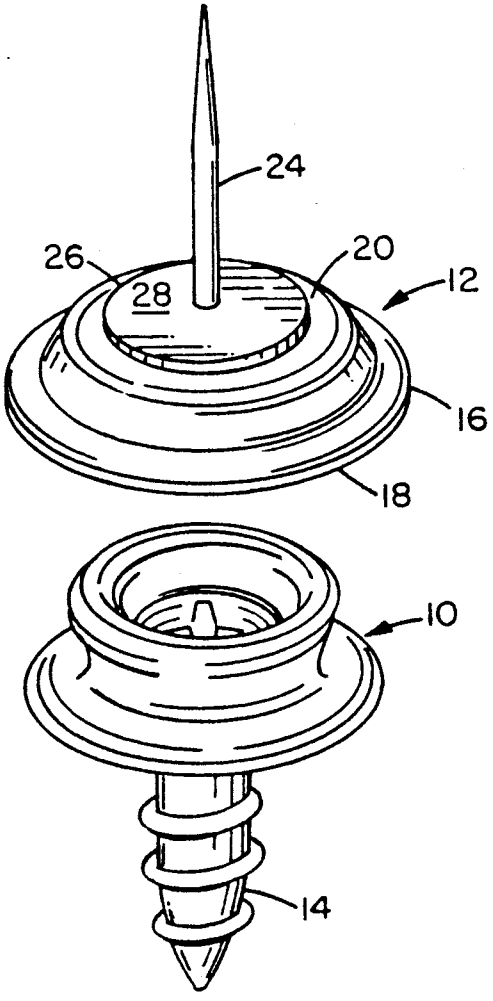
FIG. 2 is perspective view of the fabric cover marking device of present invention shown separated from a snap stud.

The present invention is directed to a marking device, designated generally by reference numeral 12, that is used to mark the locations on fabric cover B corresponding to the snap sockets that are to be removably secured to snap studs 10, each of which is secured to the top deck of boat A by threaded portion 14 (see FIGS. 2 and 3).

In accordance with the invention, marking device 12 includes a socket portion 16 having a front side 18 and a rear side 20. Socket portion 16 preferably comprises a snap socket shaped and sized to fasten onto snap stud 10. In the embodiment shown in the drawings, the snap socket comprising socket portion 16 includes snap ring 22, which snaps over the head portion of snap stud i0.

Figure 1:
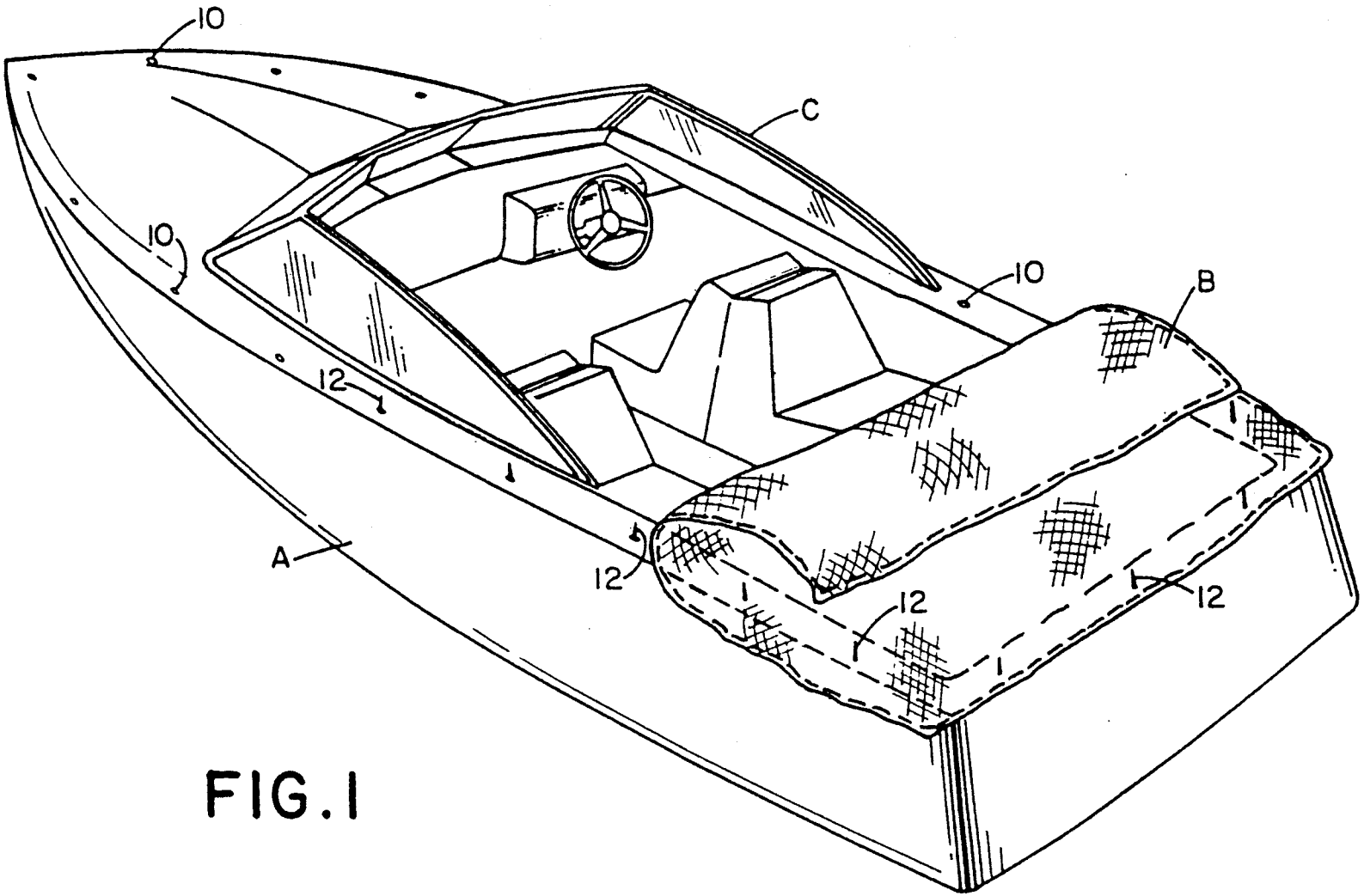
FIG. 1 is a perspective view of a boat illustrating how the fabric cover marking device of the present invention is used.

In accordance with the invention, marking device 12 also includes a pin portion 24 mounted on rear side 20 of socket portion 16. Pin portion 24 is capable of piercing fabric cover B when socket portion 16 is engaged with one of snap studs 10, as shown in FIGS. 1 and 3. In the preferred embodiment shown in the drawings, pin portion 24 comprises the sharpened, elongated member of a tack, which is designated by reference numeral 26. Tack 26 includes a flat head portion 28, which is secured to rear side 20 of socket portion 16 by, for example, soldering.

The method of the present invention for manufacturing a fabric cover for covering a structure having mounted thereon a plurality of snap studs to which the cover is to be fastened now will be described in detail.

With reference to FIG. 1, the first step of the method of the invention is securing a marking device 12 onto each of the snap studs 10 on the structure to be covered. As shown in FIGS. 1 and 3, the pin portions 24 of marking devices 12 extend vertically upward from each snap stud !0. Next, fabric cover B is disposed over the top deck of boat A and pierced with the pin portions 24 of the marking devices 12 secured to the snap studs. Finally, a snap socket is secured to cover B at each position where the cover was pierced by one of the pin portions. The snap sockets preferably are secured to the cover by riveting.

For some fabrics, for example vinyl, the actual hole formed by the pin portion can be used as the location mark for riveting a snap socket to the fabric. As a general matter, however, it is preferable to mark the location of each pin portion with chalk or some other marking material while fabric B is secured to the marking devices to assist in locating the snap sockets on the fabric at the perforations provided by pin portions 24.

It will be apparent to those skilled in the art that other modifications and variations can be made in the apparatus of the invention without departing from the scope of the invention. For example, the pin portion can be bent or hinged to the socket portion of the marking device so that the marking devices can be disengaged from the snap studs and remain attached to the fabric cover and thereby mark the locations for the snap sockets until they are riveted to the fabric. Moreover, although the invention has been described with reference to a cover for a motor boat, it can also be applied to covers for other structures, such as a cockpit cover for a sail boat or a cover for a truck bed or dump trailer. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. A device for marking the location of a snap socket on a fabric cover for a boat, the device comprising:

a socket portion configured to be releasably engageable with a snap stud of the type mounted on a boat for releasably securing a fabric cover to the boat; and a pin portion mounted on said socket portion, said pin portion being capable of marking the fabric cover at the location for the snap socket when said socket portion, is engaged with the snap stud.

2. A device for marking the location of a snap socket on a fabric cover for a boat, the device comprising:

a socket portion configured to be releasably engageable with a snap stud of the type mounted on a boat for releasably securing a fabric cover to the boat; and a pin portion mounted on said socket portion, said pin portion being capable of marking hte fabric cover by piercing the fabric cover at the location for the snap socket when said socket portion is engaged with the snap stud.

3. A device for marking the location of a snap socket on a fabric cover for a boat, the device comprising:

a socket portion having a front side configured to be releasably engageable with a snap stud of the type mounted on a boat for releasably securing a fabric cover to the boat and a rear side; and a tack having a head portion and a pin portion, said head portion being fixed to said rear side of said socket portion, said pin portion being capable of piercing the fabric cover at the location for the snap socket when said socket poriton is engaged with the snap stud.

4. The device of claim 3, wherein said socket portion is a snap socket.

5. A method for manufacturing a fabric cover for covering a structure having mounted thereon a plurality of snap studs to which the cover is to be fastened, the method comprising the steps of:

securing onto each of the snap studs a marking device comprising a snap socket portion complementary to the snap stud and having a pin portion mounted thereon;

disposing a fabric cover over the structure and over the marking devices secured to the snap studs;

piercing the fabric cover with the pin portions of the marking devices secured to the snap studs; and securing a snap socket to the fabric cover at each position where the fabric cover was pierced by one of the pin portions.

6. A method for manufacturing a fabric cover for covering a structure having mounted thereon a plurality of snap studs to which the cover is to be fastened, the method comprising the steps of:

securing onto each of the snap studs a marking device comprising a snap socket portion complementary to the snap stud and having a pin portion mounted thereon;

disposing the fabric cover over the structure and over the marking devices secured to the snap studs;

piercing the fabric cover with the pin portions of the marking devices secured to the snap studs; and marking the fabric cover at each of the locations where the fabric cover was pierced by one of the pin portions.

7. The method of claim 6, further comprising the step of securing a snap socket to the fabric cover at each location where the fabric cover is marked.

8. A method for manufacturing a fabric cover for a preselected area of a boat, the area to be covered having mounted thereabout a plurality of snap studs to which the cover is to be fastened, the method comprising the steps of:

securing onto each of the snap studs a marking device comprising a snap socket portion complementary to the snap stud and having a pin portion mounted thereon;

disposing a fabric cover over the area to be covered;

piercing the fabric cover with the pin portions of the marking devices secured to the snap studs; and securing a snap socket to the fabric cover at each position where the fabric cover was pierced by one of the pin portions.

* * * * *